US007017309B2

(12) United States Patent
McNett

(10) Patent No.: US 7,017,309 B2
(45) Date of Patent: Mar. 28, 2006

(54) WATERPROOF SEALING SYSTEM FOR A BUILDING FOUNDATION

(76) Inventor: Thomas J. McNett, 5912 Artwell, Sylvania, OH (US) 43560

( * ) Notice: Subject to any disclaimer, the term of this patent is extended or adjusted under 35 U.S.C. 154(b) by 0 days.

(21) Appl. No.: 10/287,265

(22) Filed: Nov. 4, 2002

(65) Prior Publication Data

US 2004/0083670 A1 May 6, 2004

(51) Int. Cl.
*E02D 19/00* (2006.01)

(52) U.S. Cl. ..... 52/169.14; 52/517; 52/408

(58) Field of Classification Search ..... 52/169.14, 52/292, 294, 408, 741.3, 746.1, 515, 517
See application file for complete search history.

(56) References Cited

U.S. PATENT DOCUMENTS

| | | | | |
|---|---|---|---|---|
| 4,426,817 | A * | 1/1984 | Bomhard | 52/262 |
| 4,934,122 | A * | 6/1990 | Linquist | 52/745.01 |
| 5,771,643 | A * | 6/1998 | Parker | 52/169.5 |
| 5,860,266 | A * | 1/1999 | Martinet et al. | 52/741.3 |
| 6,385,934 | B1 * | 5/2002 | Zickell et al. | 52/408 |
| 6,453,628 | B1 * | 9/2002 | Traxler | 52/169.14 |
| 6,606,836 | B1 * | 8/2003 | Miller | 52/741.14 |

* cited by examiner

*Primary Examiner*—Carl D. Friedman
*Assistant Examiner*—Jennifer I. Thissell

(57) ABSTRACT

The subject invention is a sealing system for a building structure to protect the building foundation from moisture penetration, said system comprising a layer of waterproof lining placed under the foundation and adjacent to the outer walls of the foundation or the basement structure, such lining being basically a covering over and around the foundation to protect the walls and bottom of the foundation from infiltration of moisture and water.

2 Claims, 4 Drawing Sheets

WATERPROOF SEALING SYSTEM FOR A BUILDING FOUNDATION

DISCUSSION OF PRIOR ART AND BACKGROUND OF INVENTION

The subject invention relates to sealing systems for building foundations for prevention of moisture ingress into the foundation or basement area through the foundation walls or otherwise. In this respect, sealing systems for foundations are not new, as several basement and foundation sealing systems are well known.

It is the intent of this invention to provide an improved and effective sealing system that provides complete and total moisture blockage, and one that will not require repeated repair or construction efforts to alleviate moisture problems in the basement and foundation areas. Existing sealing systems do not provide effective sealing means for the purposes stated, therefore, the subject invention is conceived accordingly.

As a background, it is noted that in foundation structuring for buildings, basement walls are adapted to enclose a spatial area under the first floor of a building. As such, basement walls are designed and structured to resist the lateral or side pressures of both soil and water functioning as vertically disposed cantilevers between the basement slab and first floor slabs. Concrete or block structures are the ideal composition for such walls.

For purposes of maintaining moisture resistance, that is, moisture ingress into the interior basement area through the walls or floors, several basic means have been utilized to help alleviate the problem. Some of the more prominent methods have been the reduction of exterior hydrostatic pressure, integral structured tightness, membranes, or surface coatings, in addition to other means. Each such method has specific shortcomings. For example, coating the interior of the basement wall is relatively ineffective. Interior sealing in the basement area may be avoided to some measure by heating or ventilation. In some instances, drainage pipes with spaced perforations disposed strategically outside the basement walls reduce lateral hydrostatic pressure as long as they can be drained into free-standing outlets. These latter methods have not proven to be totally effective, particularly when hydrostatic pressures and moisture volume vary.

The use of partial membranes along only the outside surface of a basement wall has been a method seen, however, such membranes have generally employed fabric, tar, or asphalt disposed flush on the outside wall as a continuous layered coating over the outside wall as a continuous layered coating over the outside vertical extent of the wall. In some cases, the vertical membrane is in turn covered on its outside surface by concrete or masonry creating a layered effect. This system has proven to be only moderately effective, and is relatively expensive.

Yet another frequently used and expensive method of waterproofing has been to apply a coating of waterproofing to the outer surface of the basement wall—usually this process involves the use of bituminous emulsion or mastic without use of an external membrane. One major disadvantage of such a system is that the reliability thereof diminishes when subjected to a substantial hydrostatic pressure for more than four hours continuously.

By reason of these described problems with prior art methods for moisture barrier protection, the subject invention has been conceived. The following delineated objects of the subject invention have been set forth accordingly.

OBJECTS OF INVENTION

It is an object of the subject invention to provide an improved waterproofing system for a building foundation;

A further object of the subject invention is to provide a waterproofing system for the lower portion of a residence;

Another object of the subject invention is to provide an improved system for waterproofing buildings;

Still another object of the subject invention is to provide an improved method of protecting a building foundation from moisture damage;

Yet another object of the subject invention is to provide an improved system of waterproofing buildings;

Another object of the subject invention is to provide additional moisture ingress protection for a building;

Other and further objects of the subject invention will become obvious from a reading of the description in conjunction with the drawings and claims.

DESCRIPTION OF GENERAL EMBODIMENT AND SUMMARY OF THE INVENTION

Figure 1:
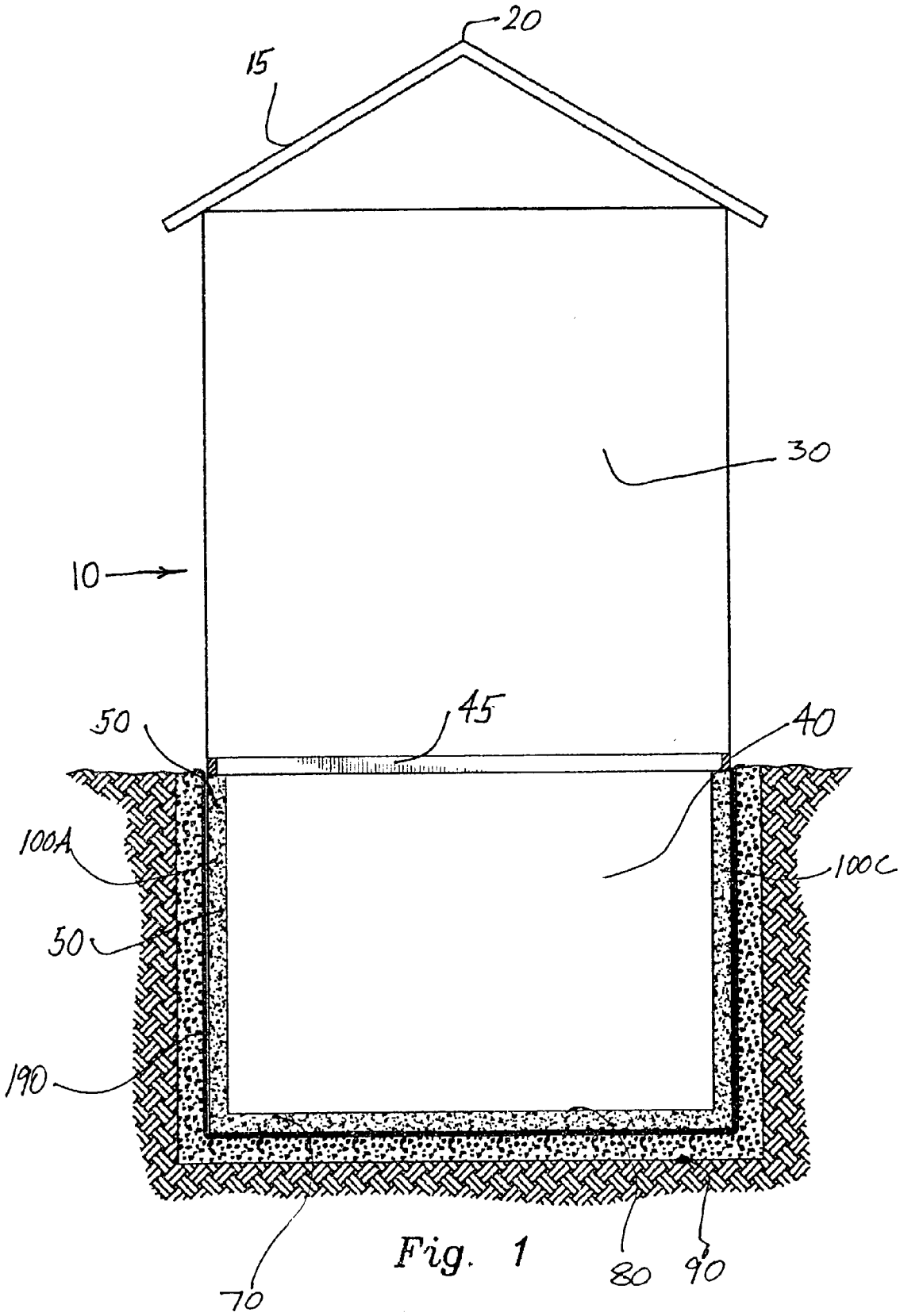
FIG. 1 is a side elevational view, partially in section, showing the subject moisture protection structure.
Figure 1A:
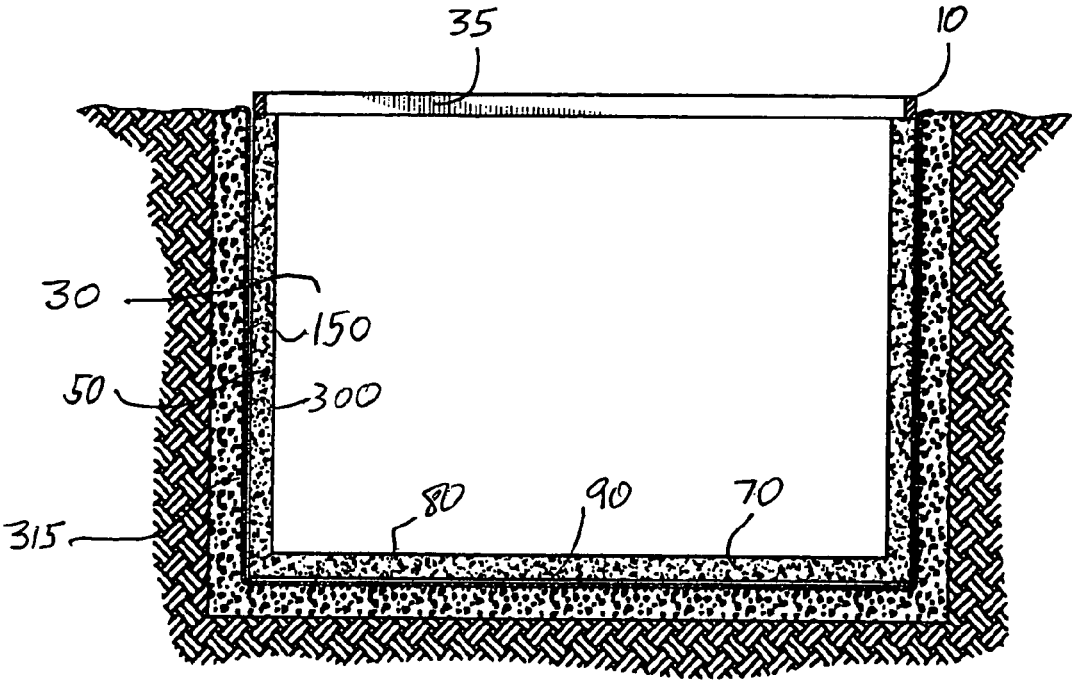

The subject invention is a sealing system for a building structure to protect the building foundation from moisture penetration, said system comprising a layer of waterproof lining placed under the foundation and adjacent to the outer walls of the foundation of the basement structure, being basically a covering over and around the foundation to protect the walls and bottom of the foundation from infiltration of moisture and water.

The subject invention is directed to a plastic-based waterproof membrane disposed completely around the outer surfaces of a building foundation or a basement, such covered outer surfaces including the vertical outer surfaces of the basement walls as well as the lower surface of the basement floor or the foundation slab, in a situation where there is no basement. The invention concept centers on applying the plastic-based covering flush against the vertical side walls as well as flush against the bottom surface of the basement floor or foundation slab. For this purpose, adhesive material may be used to accomplish the purpose. In alternate arrangements, the plastic-based membrane is spaced away a given distance from the outer surface walls by spacers affixed to the walls, by which arrangement there is an air space disposed between the plastic covering and the outer surface walls. In this latter arrangement, concrete, block, or others used to support the outer surface of the plastic cover.

DESCRIPTION OF THE PREFERRED EMBODIMENT

In describing the preferred embodiment of the subject invention, the following reference nomenclature will be used:

The word "upper" will be used in reference to areas of the building towards the upper part thereof.

The word "lower" will be used in reference to areas oriented toward the ground.

The words "lateral sides" will refer to the vertically disposed sides of a building, or any portion or subpart thereof.

The word "longitudinal" will be used to refer to that directional orientation of a part that extends over its longest extent.

The words "longitudinal axis" will refer to the central, symmetrically disposed axis extending over the longitudinal extent of the object.

The word "lateral" will be used in reference to that directional orientation of a part which extends symmetrically in a generally perpendicular direction to the longitudinal axis over the second longest dimensional extent of such part.

Moreover, in describing the preferred embodiment, the following description will be directed to cover a residential building applicacation. The invention herein will be understood to generally apply to buildings other than the residential type, and therefore any direct description and application to residential type structures should not be considered as a limitation of the scope of the subject invention. Additionally, it is to be stressed that the following description is of a specifically structured residential building, with multiple floor levels and other constructional features peculiar to that structural arrangement shown. Again, reference to such a description of a preferred embodiment and its particular constructional attributes, shall not be considered as limiting the subject invention to such precise constructional features.

Figure 2:
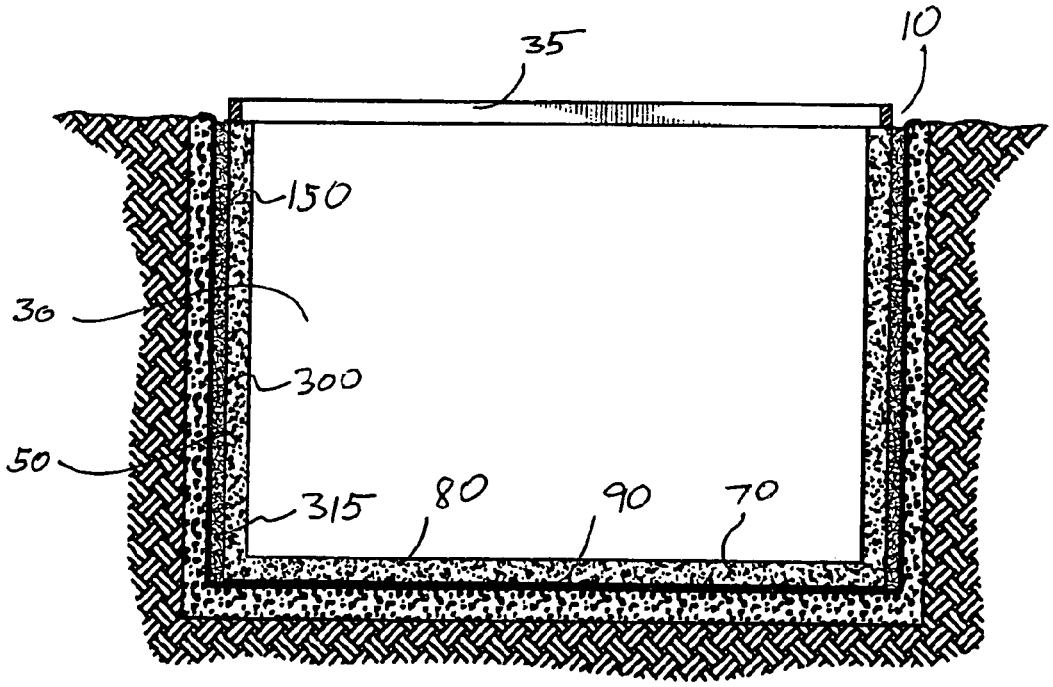
FIG. 2 is a side elevational view, partially in section, showing in outline form an alternate embodiment of the subejct invention.

Referring now to the drawings in which a preferred embodiment is shown, and particularly in FIGS. 1 and 2. Specifically, shown in FIG. 1 is a cross-sectional view from a side elevation of a conventional structured shell for a residential building 10. The residential building 10 is comprised in part of a roof 15 disposed on the upper part thereof, shown as being of the pitched variety, with peak 20. Building 10 is further comprised of the four basic living areas 30, and a basement area 40, disposed under a first floor structure 45. The basement area 40 is basically an enclosure of the building foundation 50, as seen in the drawings. The foregoing description is directed to a fairly conventional basement foundation constructional arrangement, however, it is to be understood that the subject invention and the principles thereof are equally applicable to building constructions of any shape, configuration or number of stories. Moreover, it is to be understood that the subject invention shall apply irrespective of whether or not a basement exists in the building in question.

Figure 3:
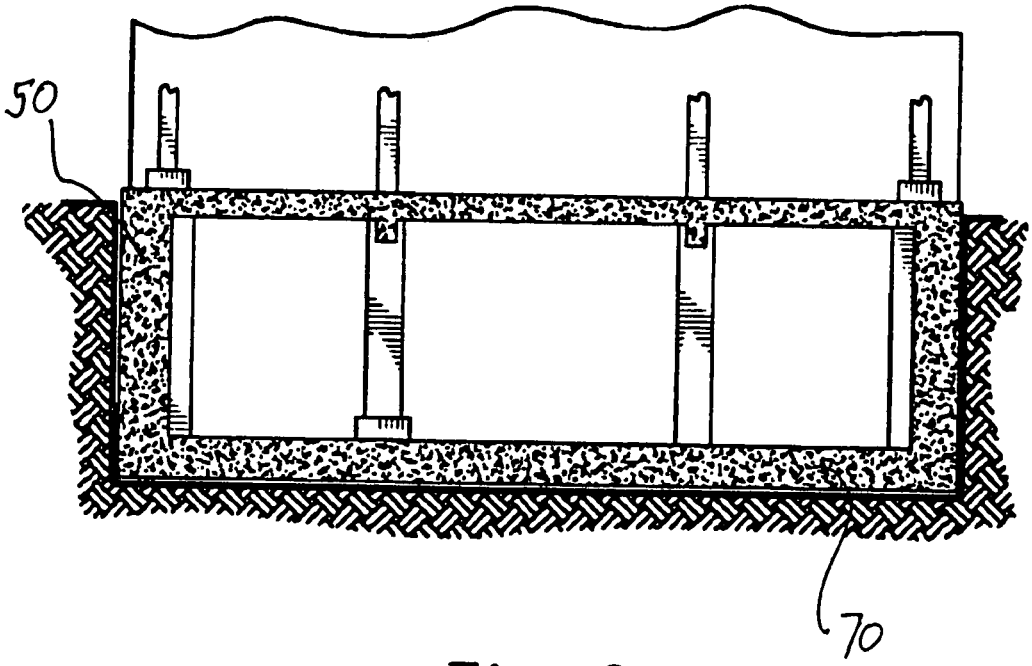
FIG. 3 is a side elevational view of the subject moisture protection system, in cross section, in relationship to the foundation support system.
Figure 4A:
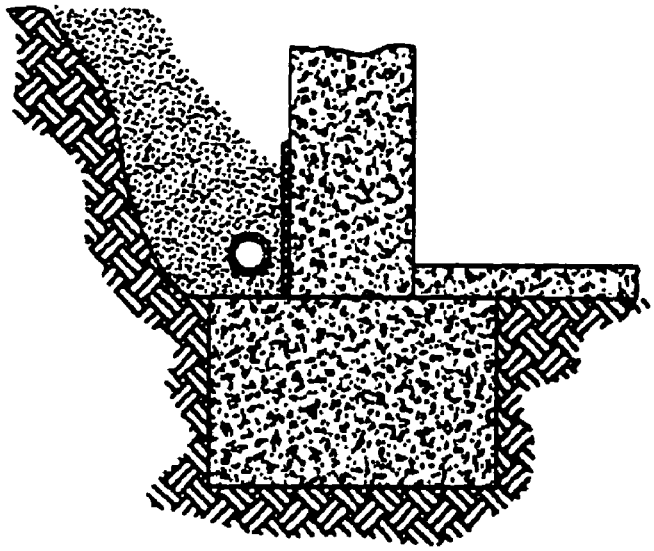
Fig. 4A Prior Art
FIG. 4A is a side elevational view in section showing existing art moisture protective systems.
Figure 4B:
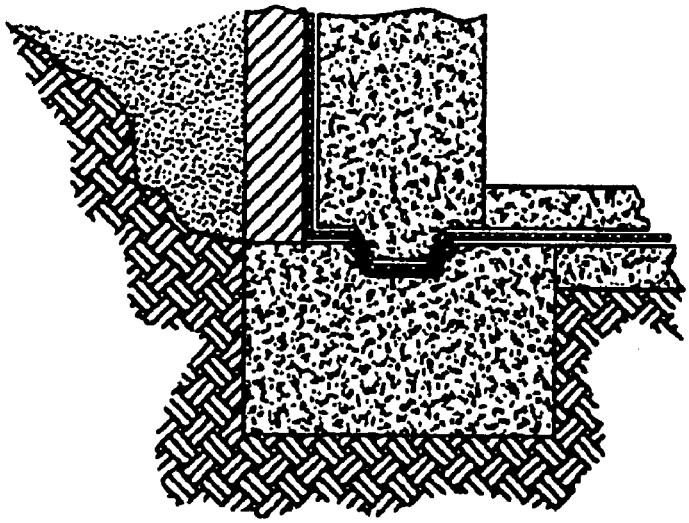
Fig. 4B Prior Art
FIG. 4B is a side elevational view of yet another existing art moisture protective system.

As seen in FIGS. 1, 2 and 3, the foundation is formed by a lower horizontal slab 70, such slab having an upper surface 80 and a lower surface 90.

Generally, the upper surface 80 of the lower slab 70 forms the floor of the basement area 30, while the lower surface is exposed to the ground. Moreover, in the usual constructional relasionship, the basement area is formed in a rectangular pattern with four lateral and vertical walls, such as opposing side walls 100A and 100C. Such vertical side walls thus form the outer vertical perimeter of the foundation.

The subject invention is directed to a plastic-based waterproof membrane disposed completely around the outer surfaces of a building foundation or a basement, such covered outer surface including the vertical center surfaces of the basement walls as well as the lower surface of the basement floor or the foundation slab, in such situations where there is no basement. The invention concept centers on applying the plastic-based covering flush against the neutral side walls as well as flush against the bottom surface of the basement floor or foundation slab. For this purpose, adhesive material may be used to accomplish this purpose. In the invention herein the plastic-based membrane is spaced away a given distance from the outer surface walls by spaces affixed to the walls by which arrangement there is an additional space between the plastic covering and the outer surface walls. In this latter arrangement, concrete block or other material is used to support the outer surface of the plastic cover. Insulating materials may be placed in such insulation area, or alternately, pesticides or other compositions adapted to prevent insect infestation may be used, Yet another substance that can be placed in such intermediate spatial area 315 could be moisture absorbing compounds, such as calcium carbonate or other similar substances. Moreover, in the embodiment whereby the membrane is placed flush against the outer surface of the vertical walls, these same latter substances may be applied between the membrane and the vertical walls.

In this embodiment, as seen in the drawings, the outer vertical surfaces and bottom surfaces of a building foundation 40 of the basement 150, such covered outer surface including the vertical outer surfaces 200A, 200B, 200C, 200D of the basement walls as well as the lower outer surface 250 of the basement floor or the foundation slab, in such situations where there is no basement. The invention concept centers in the preferred embodiment of applying the plastic-based membrane flush against the vertical side walls as well as flush against the bottom surface 250 of the basement floor or foundation slab. For this purpose, adhesive material 300 may be used to accomplish this purpose, with the adhesive material placed between the inner surface of the membrane 190 and the outer surfaces of the vertical walls.

In the second arrangement the plastic-based membrane 190 is spaced away a given distance from the outer vertical surface walls 200A, 200B, 200C by spaces affixed to the walls, by which arrangement there is a spatial area 300 between the membrane 140 and the outer surfaces of the vertical walls. In this latter arrangement, supporting block members 300A, 300B, 300C . . . may be affixed on their inner surfaces to a respectively adjoining portion of the outer surfaces off the vertical side walls. In this position the membrane 190 is attached on a portion thereof to the outer surface of adjoining supporting block members functioning to support the member 190 in a spaced away position outwardly an arbitrary distance away from the vertical side walls to provide such instulating intermediate spatial zone 315. In such spatial zone 315 such spatial zone could extend under the foundation bottom surface, however, this would not be practical.

What is claimed is:

1. A protective device in combination with a building foundation having outer foundation walls and a lower foundation surface, said protective shield comprising:

(a) a covering membrane of flexible composition, said membrane having an inner surface and an outer surface said membrane being positioned to said outer foundation walls in a spaced away relationship with said foundation walls forming a spatial area between said membrane and said outer foundation walls and, said covering membrane, said covering layer being placed flush against the said lower foundation surface of the building perimeter;

c. spacing means positioned between said foundation walls and said membrane;

d. dehydrating means placed in said spatial area between said outer foundation walls and said membrane.

2. A protective shield combined with a building foundation having outer foundation walls and a lower foundation surface, said protective shield comprising:

(a) a covering membrane of flexible composition, said membrane having an inner surface and an outer surface said membrane being positioned adjacent to said outer foundation walls in a spaced away relationship with said foundation walls forming a spatial region between said membrane and said outer foundation walls and being placed flush against the said lower foundation surface.

c. spacing means positioned between said foundation walls and said membrane;

d. dehydrating means placed in said spatial region between said outer foundation walls and said membrane, said dehydrating means comprising calcium chloride.

* * * * *